United States Patent [19]

Deike

[11] 4,320,608

[45] Mar. 23, 1982

[54] POST SUPPORT SOCKET

[75] Inventor: Robert F. Deike, Cheyenne, Wyo.

[73] Assignee: Foresight Industries, Cheyenne, Wyo.

[21] Appl. No.: 104,291

[22] Filed: Dec. 17, 1979

[51] Int. Cl.[3] ..... E02D 5/74

[52] U.S. Cl. ..... 52/165; 52/296; 403/374; 403/409; 248/316 E; 248/412

[58] Field of Search ..... 52/165, 656, 155, 156, 52/162, 296, 298; D8/47; 403/274, 367, 409, 401, 403, 374; 248/316 E, 412, 235.4; 108/148

[56] References Cited

U.S. PATENT DOCUMENTS

| | | | |
|---|---|---|---|
| 215,490 | 5/1879 | Swenson | 52/165 |
| 2,227,553 | 1/1941 | Paque | 52/153 |
| 3,011,597 | 12/1961 | Galloway | 52/156 |
| 3,066,769 | 12/1962 | Pasquale | 52/153 |
| 3,100,033 | 8/1963 | Hanson | 403/409 X |
| 3,190,602 | 6/1965 | Reilly et al. | 248/316 E |
| 3,342,444 | 9/1967 | Nelson | 248/156 |
| 3,628,296 | 12/1971 | Henry | 52/98 |
| 3,782,054 | 1/1974 | Goss | 403/401 X |
| 3,866,380 | 2/1975 | Benson | 403/295 X |
| 3,969,853 | 7/1976 | Deike | 52/156 |
| 3,972,107 | 8/1976 | Deike | 52/98 X |
| 4,021,977 | 5/1977 | Deike | 52/98 |

FOREIGN PATENT DOCUMENTS

| | | | |
|---|---|---|---|
| 60301 | 4/1954 | France | 403/374 |
| 2384143 | 11/1978 | France | 403/374 |

*Primary Examiner*—J. Karl Bell

*Attorney, Agent, or Firm*—Hill, Van Santen, Steadman, Chiara & Simpson

[57] ABSTRACT

A ground anchor for posts has a leg driven in the ground with a fluke or fin member secured to the upper end thereof and cooperating therewith to form a post receiving socket or barrel. A wedge driven in the socket clamps the post to the leg. The leg is preferably an angle iron with diverging side walls and the fin member is preferably a sheet metal strip folded midway of its length providing legs diverging from the fold or crease embracing and welded to the divergent ends of the leg side walls and then bent outwardly to radiate from the leg providing three fins or flukes in equally spaced circumferential relation and a V-wing between the crease cooperating with the legs to form the socket or barrel chamber. The post is bottomed on the leg and the wedge is bottomed in the crease of the V-wing and has diverging legs providing a recess receiving and forcing the post into the converging side walls of the leg to wedge lock the post to the leg. The wedge has a spring portion loaded by the crease and the metal strip is inclined relative to the leg so that the crease receiving this spring portion will taper from top to bottom providing a cam lock on the wedge intermediate the top and bottom ends of the strip. The wedge has holes receiving a pry tool bottomed on top of the strip to unlock the wedge and permit removal of the post.

16 Claims, 10 Drawing Figures

Fig. 1
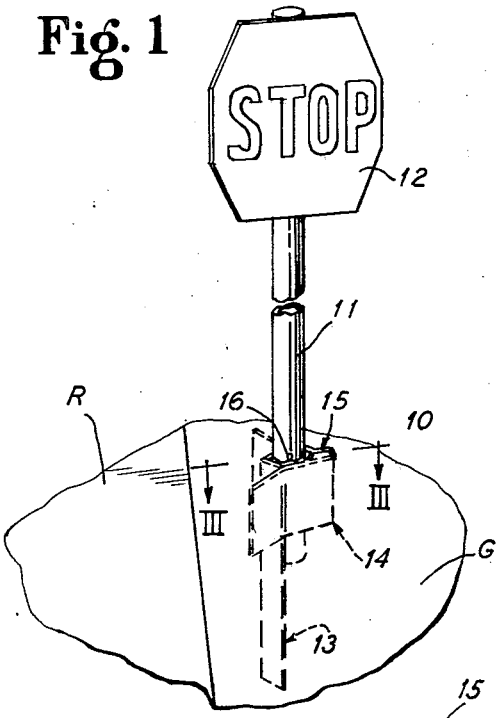
Fig. 4
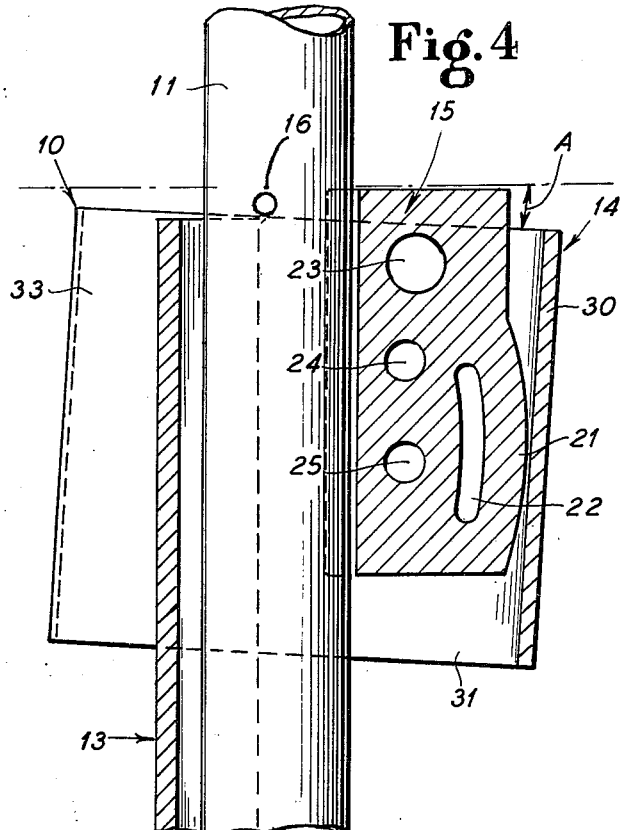
Fig. 2
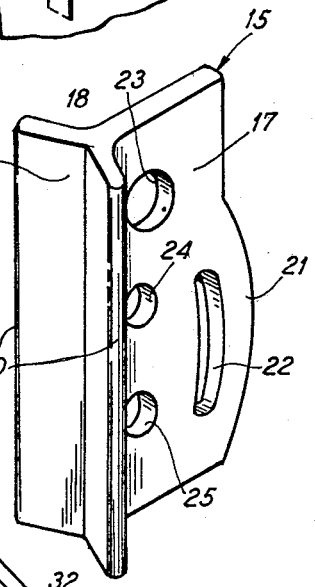
Fig. 5
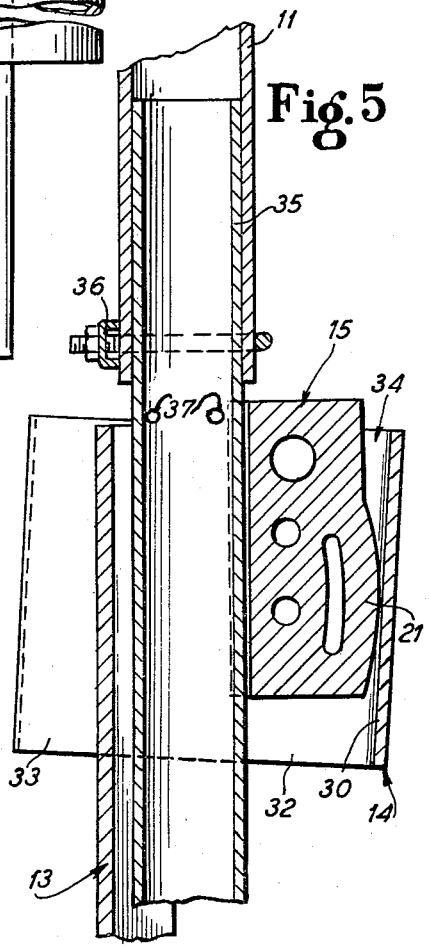
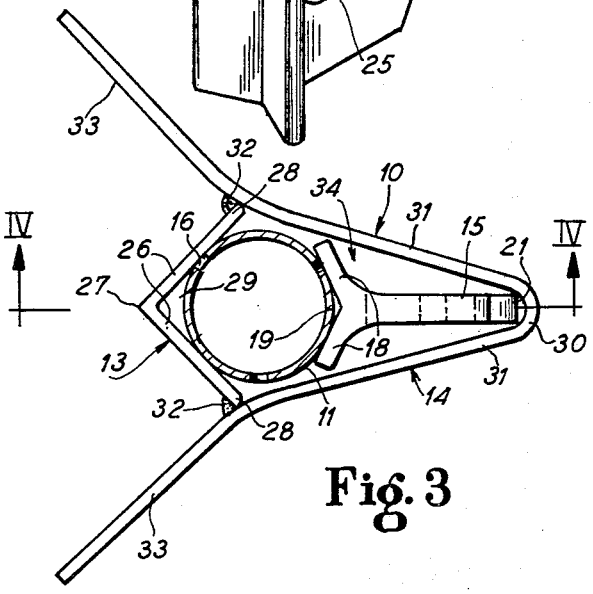
Fig. 3

POST SUPPORT SOCKET

FIELD OF THE INVENTION

This invention relates to post anchors or socket systems driven in the ground to wedge lock posts of any cross sectional shape providing a firm and strong post support avoiding the heretofor necessary deep post receiving holes and concrete footings. Specifically the invention deals with a relatively short angle iron leg with a fluke or fin ribbon or strip secured to the upper end thereof and driven into the ground with the leg to cooperate therewith in forming a post receiving socket or barrel into which is driven a wedge clamping and locking the post in the socket or barrel. The fins or flukes buried into the ground with the leg stabilize the leg against tilting or rocking in the ground.

DESCRIPTION OF THE PRIOR ART

In my prior U.S. Pat. No. 4,021,977 granted May 10, 1977, I have described and claimed a ground anchor assembly which is improved by the anchor of this application in forming the post receiving socket or barrel with a metal leg, preferably an angle iron, and a fin or fluke forming metal strip or ribbon and by canting or tilting this strip relative to the leg so that a wedge lock is obtained below the top edge of the strip thereby avoiding any possible popping of the wedge out of the socket. My present invention also provides an improved wedge having a deformable spring portion and diverging feet providing therebetween a recess receiving the post having ends providing extended post gripping areas.

SUMMARY OF THE INVENTION

According to this invention, a relatively short metal leg, preferably in the form of an angle iron, has a sheet metal strip or ribbon folded or bent with a crease to provide side legs embracing and welded to divergent ends of the sides or walls of the angle iron and then radiating beyond the angle iron leg to cooperate with the side legs extending from the crease of the strip to form three substantially equally circumferentially spaced fins or flukes. The legs of the strip from the crease to the angle iron form a V-shaped wing and cooperate with the walls of the angle iron to create a socket or barrel receiving a post. The post seats on the walls of the angle iron and is forced into wedge lock engagement therewith by a plate or slab-like wedge member bottomed in the crease of the strip and having divergent legs providing a recess receiving the post and affording relatively long gripping edges to lock against the post. The wedge is preferably a cast aluminum-magnesium alloy plate or slab with a bowed spring seated in the crease and deformed under load to effect the wedge lock. The fin or fluke forming strip or ribbon is tilted or canted longitudinally relative to the angle iron leg so that the crease will converge from top to bottom and the spring portion of the wedge will cam lock in the crease below the top edge of the strip or ribbon. The wedge lock plate or slab also has holes along the length thereof to receive a pry tool which can be bottomed on the metal strip to unlock the wedge, permitting removal of the post.

The post can be of any desired configuration since the socket or barrel will nest round, square, oval, or rectangular shaped posts. To accommodate large diameter posts, the V-wing portion of the metal strip or ribbon can be bowed outwardly.

It is preferred that the leg portion of the anchor have side walls which converge and nest the post in good gripping contact. A standard right angle iron strip or a hat section strip are available structures for the leg.

It is then an object of this invention to provide and improve ground anchor for posts and the like which have a leg with a metal strip or ribbon secured to the upper end thereof forming radiating fins and cooperating therewith to provide a post receiving socket into which is driven a wedge slab securing the post to the leg.

Another object of this invention is to improve barrel or socket type ground anchors with radiating fins by forming the barrel or socket with an angle iron leg and a fin defining metal strip.

A further object of this invention is to provide a socket or barrel type ground anchor for posts having an angle iron leg and a creased sheet metal strip embracing and welded to the divergent ends of the sides of the angle iron leg and cooperating therewith to provide a V-wing into which is driven a wedge plate having feet straddling and engaging a post bottomed in the angle iron leg.

A specific object of the invention is to provide a cast aluminum wedge lock for ground anchors.

Another object of the invention is to provide a ground anchor with a socket formed from a metal leg and a fin defining metal strip embracing and welded to the upper portion of the leg.

Other and further objects of this invention will become apparent to those skilled in this art from the following detailed description of the annexed sheets of drawings.

BRIEF DESCRIPTION OF DRAWING

FIG. 1 is a broken perspective view of a sign post anchored in the ground along a roadway by a post support socket of this invention.

FIG. 2 is a perspective view of a wedge of this invention for the post support socket.

FIG. 3 is a transverse sectional view along the line 33*iii* of FIG. 1.

FIG. 4 is a broken longitudinal sectional view, with parts in elevation, along the line IV—IV of FIG. 3.

FIG. 5 is a view similar to FIG. 4 but illustrating the use of a breakaway tube or stanchion in the post assembly.

DETAILED DESCRIPTION OF THE PREFERRED EMBODIMENTS

Figure 6:
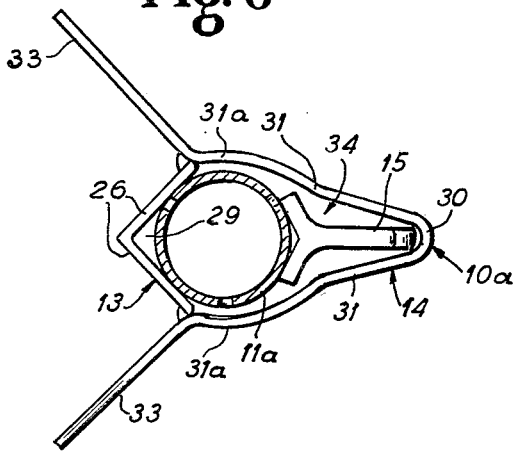
FIG. 6 is a view similar to FIG. 3 but showing the bowing of the fin member to accommodate large diameter posts.

As shown in FIG. 1, the ground anchor or post socket 10 of this invention is driven in the ground G alongside a road R supporting a post 11 for a stop-sign 12. The anchor 10 includes an angle iron leg 13, a sheet metal strip or ribbon 14 secured to the upper end of the leg 13 and bent to form radiating flukes or fins embedded in the ground G with the leg 13 and a wedge 15 inserted in the socket or barrel defined by the leg 13 and the strip 14 and receiving the post 11 therein to clamp the post in the socket. As shown the tops of the leg 13 and strip 14 are flush with the ground surface so that the wide faces of the fins or flukes defined by the strip are buried in the ground. The post 11 peripherally has one or more holes 16 therethrough level with the tip edge of the strip 14 to provide a weakened fracture zone permitting the post to bend down flush from the ground leaving a portion between the holes providing a bending retainer strap which will prevent the post from flying loose from the anchor when the post is impacted by a vehicle or the like. The strap area may be about $\frac{1}{4}$ to $\frac{1}{3}$ of the post circumference. As illustrated in FIG. 1, the post 11 is a hollow metal tube.

As shown in FIG. 2, the wedge 15 is a cast aluminum slab or plate 17 of generally rectangular configuration with diverging feet 18 along one long edge thereof defining a recess 19 receiving the post 11 and having end edges 20, 20 which can bite into the post. The opposite long side of the slab or plate 17 has an outwardly bulged or bowed spring portion 21 with an underlying elongated slot 22. This spring portion is adapted to flatten under-load to effect a spring cam lock in the fin strip 14 as will be hereinafter described. The plate or slab 17 also has a plurality of longitudinally spaced holes 23, 24 and 25 therethrough adjacent the feet 18 which are adapted to selectively receive a pry tool to eject the wedge from the socket as will be more fully hereinafter described.

As shown in FIGS. 3 and 4, the leg 13 is an angle iron member having sides or walls 26, 26 in right-angle relation and diverging from a corner 27 to ends 28, 28. These sides or walls 21, 26 converge from the free ends 28, 28 to the corner 27 forming a converging recess 29 receiving the tube 11.

The strip 14 is relatively wide but only embraces the upper end portion of the leg 13. Widths of about five to ten inches are useful.

The strip 41, as shown in FIG. 3, is bent or folded midway of its length at a crease 30 providing a pair of diverging legs 31, 31 embracing the leg 13 and welded to the ends 28 of the leg by weld bonds 32. Beyond the bonds 32, the legs 31, 31 are bent outwardly to form widely divergent legs 33, 33 cooperating with the legs 31, 31 to form three radial flukes or fins in equally spaced circumferential relation on the top end of the leg 13. The crease 30 and the diverging legs 31, 31 form a V-wing chamber 34 closed by the sides 26, 26 of the angle iron leg 13. This chamber provides a barrel or socket freely receiving the tube 11 therethrough.

The wedge 15 is inserted in this chamber 34 with its feet 18 straddling the post 11 so that the post is centered in the recess 19 and the wedge is aligned and held upright against the post as shown in FIGS. 3 and 4. The bowed spring portion 21 of the wedge 15 seats in the crease 30 of the strip and forces the feet 18 against the post to press the post against the sidewalls 26, 26 of the leg 13 causing it to be forced into the converging recess 29.

As shown in FIG. 4 the strip 14 is canted or tilted relative to the longitudinal axis of the leg 13 at an angle illustrated at A which may be in the order of five to fifteen degrees from the perpendicular. This canting or tilting inclines the crease 30 so that it converges or tapers towards the leg 13 from the top to the bottom of the strip 14.

The width of the generally rectangular wedge body 17 is such that when the feet 18 rest on the post 11, the spring portion 21 of the wedge will not become fully deformed or loaded by the crease 30 of the strip 14 until the spring is about midway between the top and bottom edges of the strip. This ensures a good cam action loading of the wedge without permitting the wedge to pop out of the open top of the V-wing chamber 34.

The post 11 is preferably dropped beyond the bottom edge of the strip 14 and may extend therefrom for any desired distance up to and even beyond the leading end of the leg 13.

To install a post in the ground anchor or socket system of this invention it is only necessary to drive the leg 13 of the unit 10 into the ground G sufficiently to bury the strip 14. Preferably the top edge of the strip 14 and the top end of the leg 13 are flush with the ground level. The post 11 is then dropped through the socket or barrel chamber 34 to a desired depth alongside the leg 13 riding on the sidewalls 26 of the leg as it is dropped into the ground. Then the wedge 15 is forced into the socket chamber 34 with its feet 18 riding on the post 11 and its spring portion 21 riding on the crease 30. The wedge can be tapped with a hammer or impact tool until the spring portion 21 is sufficiently deformed so that the feet 18 and their end edges 20 press against the post clamping it in the converging recess 20 of the leg 13.

If desired, as shown in FIG. 5 the post 11 can receive a break-away tube or stanchion 35 in the lower end thereof and secured therein by a clamp 36. This break-away tube 35 is inserted in the socket 34 exactly as described above in connection with the post 11 to be wedge-locked to the leg 13. Holes 37 are provided in the break-away tube 35 level with the top of the strip 14 and below the bottom of the post 11 to form the fracture zone described above. The break-away tube 35 can be re-used after fracture and protects the main post 11 against damage.

As shown in FIG. 6, the ground anchor **10*a* is modified to accommodate a large diameter tubular post 11*a* by outwardly bowing the side legs 31, 31 of the strip 14 as illustrated at 31*a*, 31*a* thereby providing a larger socket chamber 34 freely receiving the larger diameter post 11*a*. The modified device 10*a*** functions exactly as described hereinabove.

Figure 7:
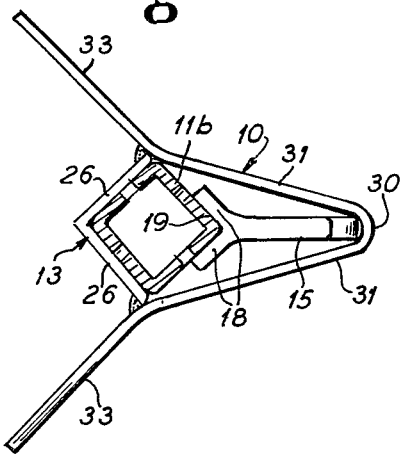
FIG. 7 is a view similar to FIG. 3 but showing a square post anchored in the socket.

As shown in FIG. 7, the ground anchor 10 also accommodates a square post **11*b* with two of its sidewalls seated against the sides 26, 26 of the leg 13 and with its opposite two sidewalls straddled by the feet 18 of the wedge 15 and seated in the recess 19** provided by these feet.

Figure 8:
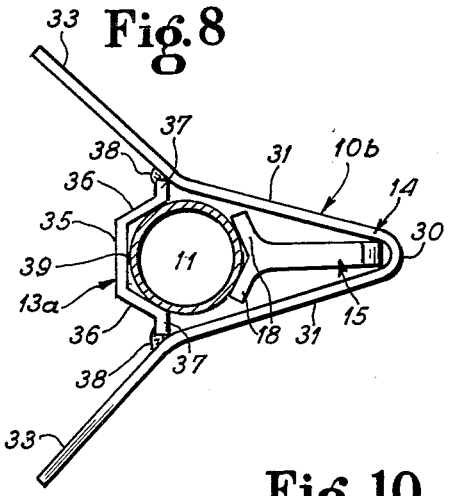
FIG. 8 is a view similar to FIG. 3 but showing a hat section leg for the socket.

As shown in FIG. 8, the ground anchor **10*b* has a leg 13*a* of hat-shaped cross section with a flat bottom wall 35, diverging sidewalls 36, 36 and outturned flanges 37, 37 with outer ends connected by weld bonds 38, 38 to the side legs 31, 31 of the metal strip or ribbon 14. The tube 11 seats in the recess 39 provided by the leg 13*a* against the sidewalls 36, 36 in the same manner as it seats in the recess 29 of the angle iron leg 13. The rest of the structure is identical with that described in connection with the anchor 10** and functions in the same manner.

Figure 9:
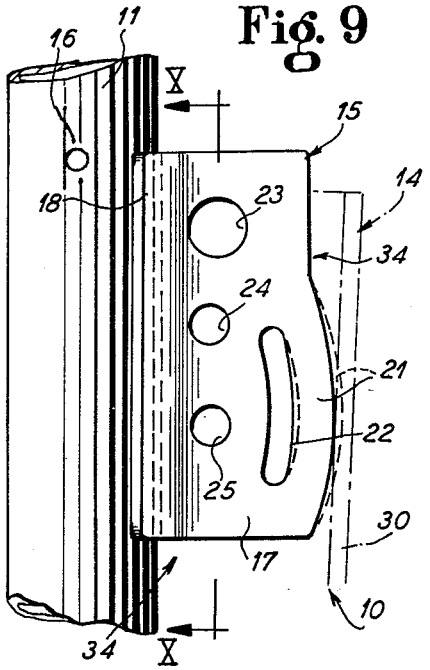
FIG. 9 is a detailed sectional view, with parts in elevation, illustrating the cam lock wedge action.
Figure 10:
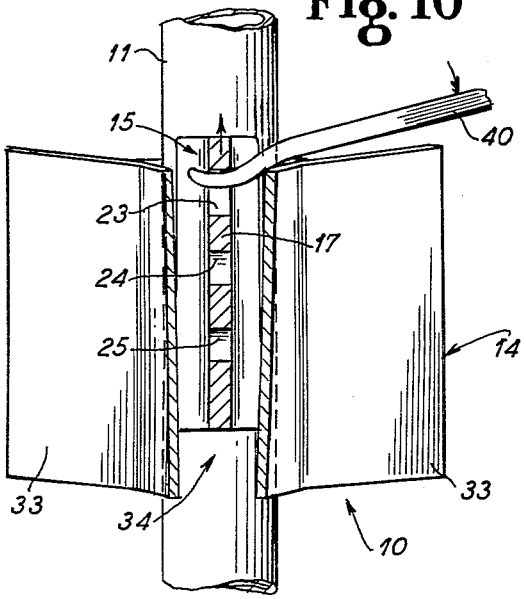
FIG. 10 is a sectional view along the line X—X of FIG. 9 showing the manner in which the wedge may be pried loose.

As shown in FIGS. 9 and 10 when the wedge 15 is forced downwardly in the socket chamber 34, the bowed spring portion 21 will flatten from the dotted line position to the solid line position under the cam action of the tapered crease 30. This forces the feet 18 of the wedge 15 against the post 11 and under high load will cause the end edges 20 of these feet to bite into the tube. The spring 21 however can be sized and shaped so as to control the load on the post so as to prevent crushing or damaging of the post.

As illustrated in FIG. 10 when it is desired to release the post from the ground anchor 10 a pry tool 40 may be inserted in a hole such as 23 of the wedge 15 and fulcrummed on the top edge of the strip 14 to pull the wedge out of the socket chamber 34.

The following table lists preferred specifications for sizes of ground anchors according to this invention.

| MAXIMUM ROUND TUBE OUTSIDE DIAMETER | FIN SIZE | METAL GAUGE SIZE | ANGLE IRON LEG SIZE |
|---|---|---|---|
| 1.66" | 5" × 12" | 12 | 3/16" × 1½" × 18" |
| 1.90" | 8" × 12" | 12 | ¼" × 1¾" × 24" |
| 2.38" | 8" × 15" | 10/12 | ¼" × 2" × 30" |
| 2.87" | 8" × 15" | 10 | ¼" × 2½ × 30" |

For square tubes up to 2.25 inches, a preferred fin size is 8 inches high by 15 inches long formed of ten to twelve guage steel and a preffered angle iron leg size is ¼ inches thick by 2½ inches on each side with a length of 30 inches.

From the above descriptions it will be understood that the post ground anchors of this invention are relatively short in length, have sockets or barrels formed by a structural steel leg preferably a right-angle strip and a sheet metal fin forming strip or ribbon cooperating with the leg to provide a post receiving socket and a wedge which locks the post in the socket. The wedge has a integral spring controlling the maximum wedge load and locks in the socket intermediate the top and bottom ends thereof. It will of course be appreciated that many deviations may be made from the descriptions and drawings without departing from the principles of this invention.

I claim as my invention:

1. A ground anchor for posts and the like which comprises a leg adapted to be driven in the ground having a wall adapted to receive a post thereagainst, a strip secured to the upper end of said leg cooperating therewith to form a socket receiving the post, and a wedge in said socket bottomed on said strip forcing the post against the wall of the leg in clamped relation.

2. A ground anchor which comprises a metal leg having diverging sidewalls, a metal strip having a crease with diverging legs embracing the sidewalls of the metal leg and secured thereto, said walls of the metal leg and said legs of the strip cooperating to define a post receiving socket, said strip having said legs thereof bent to define fins radiating from the metal leg, and a wedge fitting said socket having a side edge fitting said crease and an opposite recessed edge receiving a post in the socket and said wedge and crease being dimensioned relative to the post in the socket to lock the post against the walls of the metal leg.

3. A ground anchor comprising an angle iron leg adapted to be driven upright into the ground, fins radiating from the upper end of said leg cooperating therewith to form a post receiving socket, and a wedge plate fitting said socket to wedge-lock a post therein.

4. The ground anchor of claim 1 wherein the leg is an angle iron with sidewalls in right angle relation forming a recess receiving the post.

5. The ground anchor of claim 1 wherein the leg is a metal strip of hat-shaped cross section with a flat wall and diverging sidewalls defining a recess receiving the post.

6. The ground anchor of claim 1 wherein the wedge is a generally rectangular metal plate having diverging feet along one side thereof straddling the post in the socket.

7. The ground anchor of claim 1 wherein the wedge is a resilient cast aluminum slab with a bowed spring portion along one edge thereof and diverging feet along the opposite edge thereof.

8. The ground anchor of claim 1 wherein the metal strip is canted relative to the leg.

9. The ground anchor of claim 2 wherein the metal leg is a right angle structured angle iron.

10. The ground anchor of claim 2 for tubular posts wherein the diverging legs of the strip are outwardly bowed to accommodate large diameter tube posts.

11. The ground anchor of claim 3 wherein the fins are formed from a metal strip welded to the ends of the sides of the angle iron leg.

12. The ground anchor of claim 3 wherein the angle iron leg has a hat shaped cross section.

13. An anchor wedge adapted to secure a post in a ground anchor having a V-wing chamber receiving the post in the divergent end thereof with the wedge bottomed in the convergent thereof which comprises a one-piece rectangular slab having a post receiving recess along one edge thereof effective to align and hold the slab upright in said chamber against the post, said slab having an edge opposite said recessed edge with an outwardly bowed spring portion adapted to be depressed by said convergent end of the V-wing chamber for pressing the recessed edge of the slab against the post for wedge locking the post in the chamber.

14. The wedge of claim 13 wherein the one-piece rectangular slab is an elongated rectangle with the recess defined by diverging feet coextensive with one long edge of the slab and effective to straddle the post.

15. The wedge of claim 13 wherein the spring portion is an outwardly bowed arcuate section and an elongated arcuate slot in the slab underlies said section.

16. The wedge of claim 13 wherein the rectangular slab is an elongated rectangle and transverse pry holes extend through the slab in longitudinally spaced relation along the length thereof adapted to receive a pry tool for retracting the slab from the V-wing chamber.

* * * * *